US005816496A

United States Patent [19]

Kovacs

[11] Patent Number: 5,816,496

[45] Date of Patent: Oct. 6, 1998

[54] GAS FIRED HUMIDIFIER

[76] Inventor: James E. Kovacs, 92 Tripp Crescent, Nepean, Ontario, Canada, K2J 1C8

[21] Appl. No.: 637,394

[22] Filed: Apr. 25, 1996

[51] Int. Cl.[6] ..... F24F 3/14; F24F 5/00

[52] U.S. Cl. ..... 237/78 R; 122/31.1; 122/31.2; 122/34; 122/44.2; 122/14; 261/DIG. 76; 126/113

[58] Field of Search ..... 122/31.1, 31.2, 122/34, 44.2, 14; 261/DIG. 76; 237/78 R; 126/113

[56] References Cited

U.S. PATENT DOCUMENTS

| | | | |
|---|---|---|---|
| 2,169,683 | 8/1939 | Dunham et al. | 122/31.1 |
| 4,474,117 | 10/1984 | Marollaud | 110/109 |
| 4,672,919 | 6/1987 | Staats | 122/13.1 |
| 4,697,735 | 10/1987 | Temple | 237/78 R |
| 5,215,043 | 6/1993 | Tsutsumi | 122/39 |
| 5,355,841 | 10/1994 | Moore, Jr. et al. | 122/14 |
| 5,422,976 | 6/1995 | Knepler | 122/13.2 |
| 5,544,625 | 8/1996 | Rivern | 122/44.2 |

FOREIGN PATENT DOCUMENTS

| | | | |
|---|---|---|---|
| 94/10511 | 5/1994 | WIPO | 122/13.1 |

*Primary Examiner*—Henry A. Bennett
*Assistant Examiner*—Jiping Lu
*Attorney, Agent, or Firm*—Stanley E. Johnson

[57] ABSTRACT

A compact fuel fired steam generating type humidifier. The apparatus uses a gaseous fuel as the prime source of heat to generate steam used to humidify air in the heating, ventilation and air conditioning of buildings. The humidifier may be a stand alone unit that disperses the steam into the space or the steam generated by the apparatus may be dispersed in forced air flow of the building heating system. The steam generating unit includes a water tank in which there is located a combustion chamber and a heat exchanger chamber for transferring the heat from the products of combustion to the water.

29 Claims, 4 Drawing Sheets

GAS FIRED HUMIDIFIER

FIELD OF INVENTION

The present invention relates to a fuel fired steam generating type humidifier. The apparatus uses a gaseous fuel as the prime source of heat to generate steam used to humidify the air in the heating, ventilation and air conditioning a building. The humidifier may be a stand alone unit that disperses the steam into the room where it is located or the steam generated by the apparatus may be dispersed in forced air flow of the building heating system.

BACKGROUND OF THE INVENTION

Humidification of air is an operation concerned with an interphase transfer of mass and energy that occurs when air is brought into contact with water in which the air is essentially insoluble. Depending on whether the water is in a form of a liquid or a vapour, there are two air humidification processes: a) An adiabatic process, in which the air is brought into a direct contact with water and the required evaporation heat is extracted from the air that is being humidified, and b) An isothermic process, in which a water vapour at atmospheric pressure is added to the air to increase its moisture, in which the heat energy of the air is unaffected.

The isothermic humidification process is usually carried out in a central air conditioning air duct system or in an open space, by the distributing and mixing of a stream of atmospheric steam with a stream of air. The amount of steam that can be added to a stream of air is limited and depends on the dry bulb temperature and the absolute moisture content of the air. The steam for humidifying the air may be produced either at the location of the steam distributor in a compact humidifier, or it can be delivered to a steam distributor or injector from a central boiler.

Technical and commercial literature indicate, that the current art compact isothermic humidifiers produce steam in a sealed water tank by boiling and evaporating the incoming feed water at atmospheric pressure in a cyclic single stage evaporation process. The required heat is provided either by electric power via two or more electrodes or electric resistance heating elements submerged in the boiling water, or by steam under pressure delivered from a central steam boiler in a submerged heat exchanger.

An electric steam generating humidifier is disclosed in U.S. Pat. No. 4,239,956 issued Dec. 16, 1980 and reissued Oct. 30, 1990 as RE Pat. No. 33,414. Referred to in this patent are Rea U.S. Pat. No. 3,386,659 and Fraser U.S. Pat. No. 3,436,697 as disclosing a steam generator in combination with duct work of a forced air heating system.

Disclosed in U.S. Pat. No. 4,564,746, issued Jan. 14, 1986 to B. W. Morton et al, is a cabinet type steam generating room humidifier.

The feed water used in compact isothermic humidifiers may be a city water, softened water, deionized water (DI) or reverse osmosis treated water (RO). Regardless of the feed water quality, all compact isothermic humidifiers are provided with a method to control the flow of the feed water into the water tank, a method to control the volume and the water level in the water tank, and a method to control the operating pressure in the water tank.

As the feed water is converted into steam, impurities which enter with the feed water are concentrated in the water tank. Of concern are mainly the inorganic compounds of hard scale forming substances such as calcium and magnesium. Each substance has its own solubility limit in water solution. When its concentration exceeds the solubility limit, the excess substance precipitates and builds up a hard scale on the submerged electric resistance heating elements, electrodes, heat exchanger, and the water tank walls. The build up reduces the overall heat transfer rate. To maintain the performance and the efficiency of the humidifier, the water tank, the submerged heating elements and the heat exchanger are regularly cleaned, and the water tanks provided with the electrodes are regularly replaced at a considerable maintenance and replacement material cost.

To extend the operating period of the water tank, all isothermic humidifiers operating with feed water containing dissolved solids (TDS) are provided with a method to control the concentration of TDS in the boiling water to reduce the hard scale build up rate. Most of them control the TDS in the boiling water by a regular periodic blowdown of a mixture of feed water and boiling water which results in excessive consumption of feed water and with excessive heat loss with the blowdown water.

A major concern with the current art compact isothermic humidifiers are the very high operation energy cost and operation maintenance cost. The high operation energy cost is the result of use of the electric power as the source of the energy required in the production of steam. The high operation maintenance cost is due to the required regular cleaning of the water tank and of the submerged electric resistance heating elements or heat exchanger, or the regular replacement of the water tank operating with electrodes due to the excessive build up of hard scale.

SUMMARY OF THE INVENTION

A principal object of the present invention is to provide a steam generating type humidifier that uses combustion of a gaseous or a liquid fuel in heating, boiling, and evaporating feed water in a process carried out in a water tank so designed as to maximize heat transfer from the heat generated by the products of combustion to water in the water tank operating at substantially atmospheric pressure.

Another aspect of the present invention is to provide a compact humidifier that will produce a continuous stream of clean atmospheric steam by combustion of a fuel in a firebox combustion chamber within a water tank in which the steam is produced.

Another object of the present invention is to provide a compact apparatus for a continuous production of steam by combustion of a fuel in a firebox combustion chamber, in which the combustion chamber walls, in contact with the hot combustion gases, have an extended heat transfer surface to increase the heat transfer rate from the hot combustion gases into the boiling water.

A further object of the present invention is to provide a compact apparatus for a continuous production of steam from feed water, containing dissolved solids, in a water tank at atmospheric pressure under conditions of a periodic flow of feed water and a variable water level of the boiling water.

Another object of the present invention is to provide a compact apparatus for production of steam from feed water containing dissolved solids in a water tank at an atmospheric pressure with the concentration of TDS in the water tank maintained within the solubility limits of hard scale forming substances.

BRIEF DESCRIPTION OF THE DRAWINGS

The invention is illustrated by way of example with reference to the accompanying drawings wherein:

FIGS. 4 and 5 illustrate an alternate combination combustion chamber and heat exchanger design that is completely surrounded by water wherein FIG. 4 is a side, part broken away, view of the water tank and combustion chamber;

FIG. 5 is a part broken away and elevational view of FIG. 4; and

DETAILED DESCRIPTION OF PREFERRED EMBODIMENTS

Figure 1:
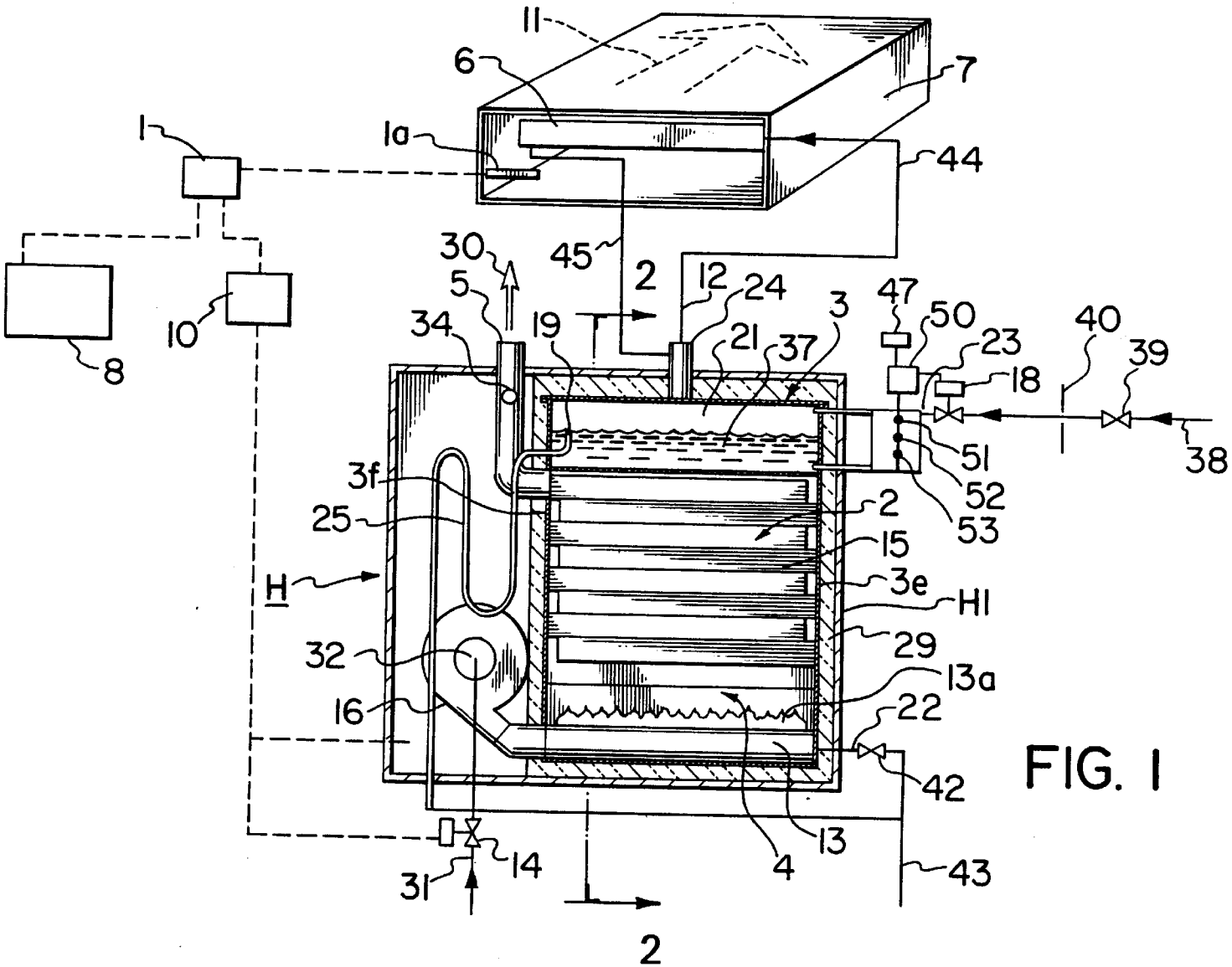
FIG. 1 is a part schematic, part sectional illustration of the preferred embodiment of the humidifier system of the present invention intended for use in heating, ventilating and air conditioning of buildings for humidification of air. The humidifier portion is a sectional view essentially along the line 1—1 of FIG. 2.

Schematically illustrated in FIG. 1 is a humidifying system comprising a steam generating device H of the present invention that produces and provides steam to a steam distributor 6 in a duct 7 of a building forced air system. Various arrangements for a duct and steam injector system are known some of which are illustrated in the aforementioned U.S. Pat. RE 33,414 and thus are not further described herein.

The device H has a water tank unit 3 that contains a combined combustion chamber 4 and heat exchanger 2. Walls of the combustion chamber and heat exchanger define the flow path and provide the heat exchange surfaces for the hot gases that are the products of combustion. The walls are completely or essentially completely immersed in the water in the tank. There is a forced draft combustion system that includes a burner 13 (with the flame thereof designated 13*a*) and forced draft fan 16 controlled by a humidistat 1 having a sensor 1*a* in the duct 7 and a combustion controller 10.

The humidistat 1 with the sensor 1*a* controls the humidification process carried out in the air duct 7. Depending on the application and the type of humidification process, the humidistat may be either an ON-OFF or time proportioning type for regulation of the periodic humidification process, or a modulating humidistat for regulating the continuous humidification process. Humidistat 1 and the combustion controller 10 for the burner 13 including the forced draft fan 16 are inter-related, and together they operate to control the humidification of the air stream 11 in the air duct 7 and the production of steam in the water tank 3. A monitor 8 tracks the performance and operation of the humidifier. For space humidification application the air duct 7 is replaced by a conventional air fan compartment 7*a* (FIG. 2) with an air fan unit 7*b* for providing the equivalent of air stream 11. Steam exits from the enclosure compartment 7*a* via a steam distributor 7*c*.

The forced draft combustion system, includes the previously mentioned combustion controller 10 that controls ignition and flame of the forced draft burner 13, and a combination gas valve 14, the forced draft fan 16, and a flue discharge duct 5. The combination gas valve 14 may be a proportional solenoid valve when using a modulation humidistat, or an ON-OFF type solenoid valve for use with an ON-OFF or a time proportioning type humidistat. To improve the combustion efficiency the proportional gas valve 14 may be replaced by a modulating constant air/fuel ratio valve train (not shown in FIG. 1). An induced draft combustion system replacing the described forced draft combustion system could be used.

The water tank unit 3 is a sealed, i.e. closed water tank of a corrosion resistant material such as stainless steel and of a rectangular shape designed for operating at substantially atmospheric pressure. As an example, the capacity of the tank is 85 kilograms of water. The water tank 3 has respective outer major side walls 3*a*, 3*b*, a top wall 3*c*, a bottom wall 3*d* and end walls 3*e*, 3*f*. Top wall 3*c* is removably attached as by threaded fasteners 3*g* or other suitable means. This allows for periodically cleaning out the tank.

The tank is completely surrounded by insulation 29 and as seen in FIG. 1, the tank unit is contained in an outer housing H1. The water tank, and walls defining the combustion chamber and heat exchanger chamber are constructed and/or so arranged such that the water in the tank completely or essentially completely surrounds the combustion chamber and heat exchanger.

Figure 3:
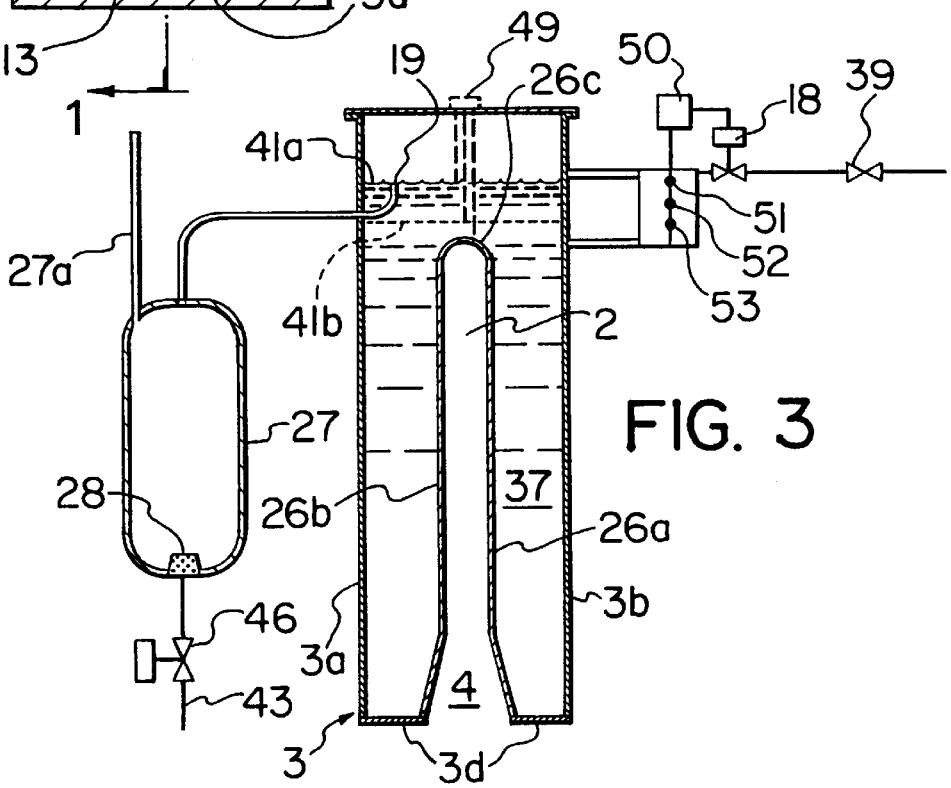
FIG. 3 illustrates an alternate blowdown tank and an alternate conductive probe level sensor device.

Referring to FIG. 3 the bottom wall 3*d* is separated into two spaced apart portions by upwardly directed water tank inner side walls 26*a* and 26*b* which are joined at their upper end by a top end wall 26*c*. These latter walls together with end walls 3*e*, 3*f* define the combustion chamber 4 and the chamber of the heat exchanger 2. In this embodiment the combustion chamber 4 is closed on the bottom by the insulated bottom wall of the outer casing or housing H1.

Figure 5:
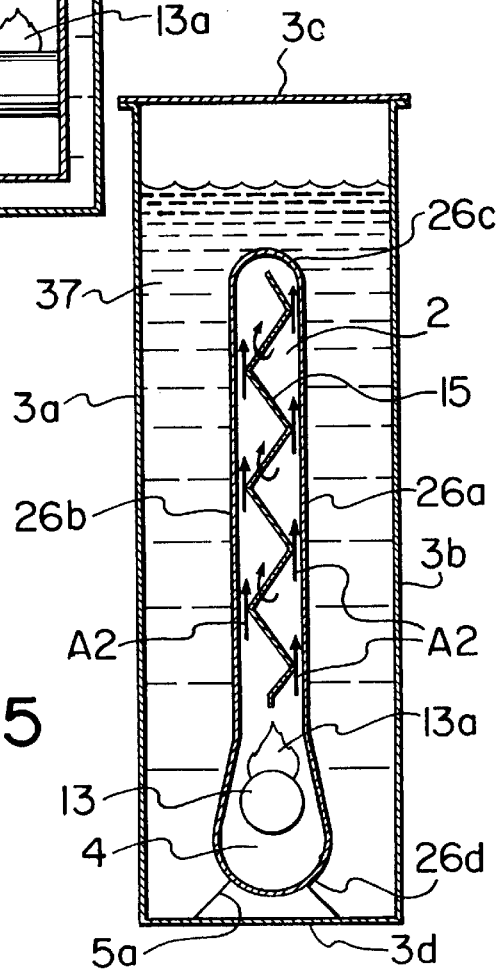

FIG. 5 illustrates an alternative construction where the combustion chamber has a bottom wall 26*d* which is spaced upwardly from the water tank bottom wall 3*d*. In this embodiment the combustion chamber and heat exchanger chamber are closed at the end by respective end walls 26*e* and 26*f*. These latter walls are spaced from the water tank respective end walls 3*e* and 3*f* and maintained in spaced relation therewith by spacers S. The bottom wall 26*d* of the combustion chamber rests on one or more saddles 5*a*. From this it is evident the heat exchanger chamber and combustion chamber in the lower portion thereof is completely immersed in water when the tank is filled to its predetermined operative level which during operation varies between a high level 41*a* and a low level 41*b* (see FIG. 3).

Water is supplied to the tank through a feed water solenoid valve 18 that is interconnected with a water level controller 50 and a variable timer 47 actuated by float controlled switches 51, 52. These control the flow of feed water and the water level of the boiling water in the water tank. The float control switches could be replaced by a level control unit 49 (shown in broken line in FIG. 3) having three probes that are activated by contact with the water surface. The level sensing means, as is apparent from this, may be located either in the main water tank or in an external chamber as shown. An overflow skimmer pipe 19 protects the water tank from overfilling. A feed water discharge outlet 23 is located so that the water therefrom discharges into the evaporative chamber 21. An outlet 24 is provided for the discharge of steam 12 via conduit means 44 to the steam distributor 6 and it also provides for condensate return via conduit 45. The overflow skimmer conduit 19 discharges into a drain 43 through a water seal 25.

Feed water flows into the water tank 3 via a water pipe 38, shutoff valve 39, flow restrictor 40, solenoid valve 18, and the discharge outlet 23. The flow restrictor 40 is provided for controlling the flow rate of feed water and this along with solenoid valve 18, controller 50 and float switches 51 and 52 maintains the water in water tank 3 between the predetermined high and low water levels designated respectively 41*a* and 41*b* (FIG. 3). A manual drain valve 42 in drain pipe 22 is provided for the seasonal draining of the water tank 3 via drain pipe 43 to a common sewer line.

The steam distributor 6 is a conduit with apertures or nozzles for distribution of the steam 12 into the air stream 11 passing through the air duct 7. The steam is delivered to the distributor 6 from outlet 24 via a steam pipe 44 and the condensate is returned via pipe 45.

The water tank 3 has thermal insulation 29 on all surfaces thereon to minimize heat loss from the hot water for improved efficiency and reduced time to the start of steam production.

Figure 2:
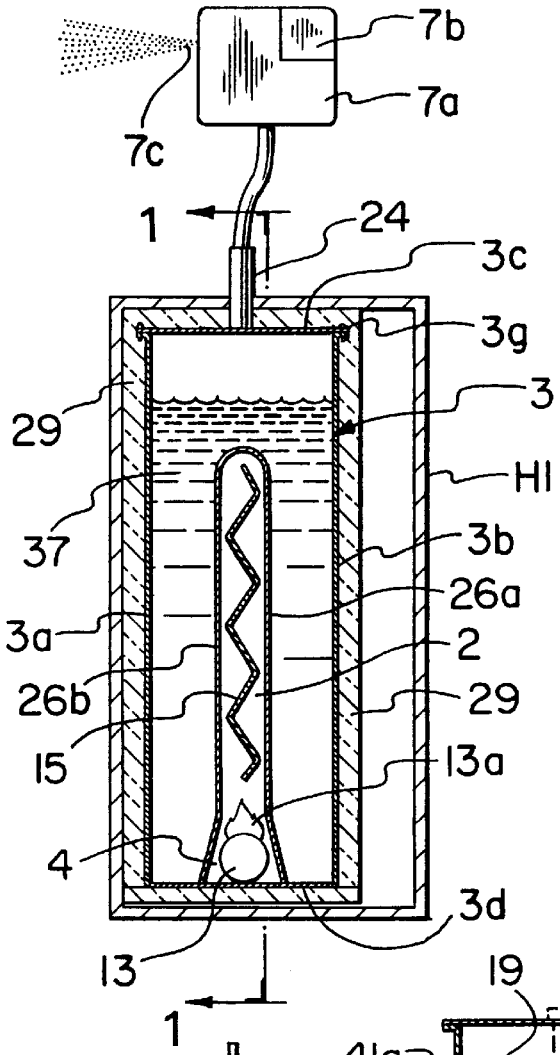
FIG. 2 is a sectional view essentially along line 2—2 of FIG. 1, and also diagrammatically illustrates a self contained room type humidifier.

A gaseous fuel 31 mixes with combustion air 32 in the forced draft fan 16. This mixture goes to the burner 13 and combustion is controlled by controller 10. Flow of the fuel 31 is regulated by the gas valve 14 controlled by the humidistat 1 through combustion controller 10 and flow of the combustion air 32 is regulated by the forced draft fan 16 which is also controlled by controller 10. The major portion of the heat from combustion of fuel is transferred from the combustion gases 30 to the water while the gases pass through the combustion chamber 4 and heat exchanger 2. The heat transfer to the water is through the two side walls 26*a*, 26*b* and top 26*c* of the heat exchanger (FIGS. 2, 3). The combustion gases, with the remainder of the heat therein, leave the heat exchanger via duct 5 to outdoors. The heat exchanger 2 contains a baffle means 15 that improves the heat transfer to the heat exchanger walls 26*a* and 26*b*. The two walls 26*a*, and 26*b*, of the heat exchanger that are in contact with the hot combustion gases may also be corrugated or provided with fins to further increase the heat transfer rate into the water in the tank.

Figure 4:
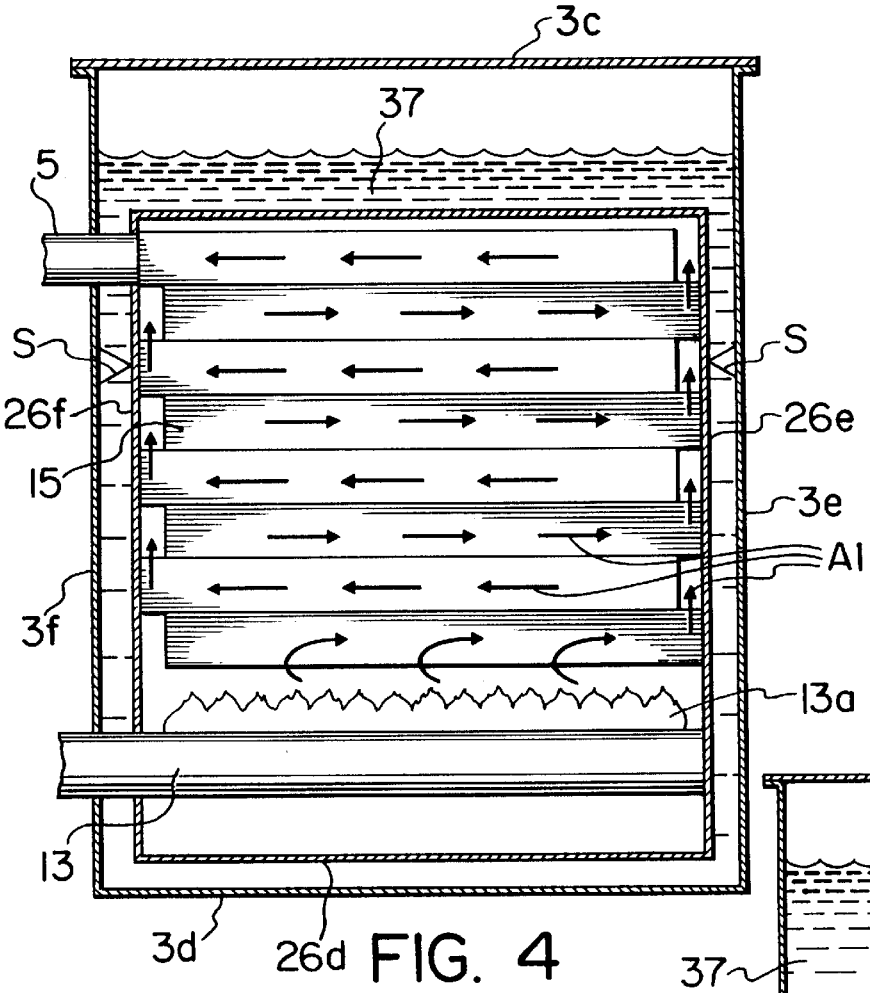

Baffle means 15 may be variously designed for maximizing heat transfer from the combustion gases to the water in the tank. In the embodiment illustrated a baffle is arranged to provide a primary zig-zag flow path represented in FIG. 4 by arrows A1, and a secondary or leakage flow path represented by arrows A2 in FIG. 5.

While the present embodiment uses a rectangular water tank, it can be appreciated by those with skills in the art, that the same arrangement of the described parts and same results can be achieved with an alternative shaped water tank.

The water tank 3, exhaust fan 16, and the flue discharge duct 5 are protected against overheating by a high temperature limit control switch 34 located near the exit of the heat exchanger in the flue discharge duct 5 and suitably connected to deactivate the system upon reaching an overheat situation. Further overheat protection is provided by a low water level float switch 53 suitably connected to deactivate the system upon reaching an abnormally low water level in the water tank 3. It can be appreciated, that if desired, the described gaseous fuel may be conveniently replaced by a liquid fuel to achieve the same result.

If desired, a monitor, not shown, including sensors, processors, clock, timer, and displays may be provided to monitor and display the performance and operation of the humidifying system.

Operation of the described embodiment of the present invention, when controlled by the modulating humidistat, is as follows.

The modulating humidistat 1 continuously monitors the humidity load demand of the air 11 in air duct 7 and through combustion controller 10 regulates the operation of the burner 13 and of the proportional gas solenoid valve 14. The required combustion air 32 is forced through the burner by the forced draft fan 16. Combustion of the gaseous fuel 31 with combustion air 32 occurs at the burner 13 in the combustion chamber 4. Combustion of the fuel produces the process heat required for heating the water 37 to boiling temperature and for production of the required amount of steam 12 to be added to the air stream 11 in the air duct 7 through the steam distributor 6.

The required process heat is recovered and transferred from the hot combustion gases 30, passing through combustion chamber 4 into and through the heat exchanger walls 26*a*, and 26*b*, into the water 37 causing it to boil. The flue gases cool as they are forced through the combustion chamber 4 and heat exchanger 2 by the forced draft fan 16 and are discharged via the duct 5 to outdoors.

The steam for humidification is produced in a cyclic evaporation process controlled by the modulating humidistat and carried out in water tank 3 at substantially atmospheric pressure in three operating periods.

The first operating period involves the process steps of a continuous combustion of fuel and transfer of heat from combustion gases to boiling water, the evaporation of boiling water, separation of the produced steam from the boiling water, concentration of dissolved solids in the boiling water, and discharge of the produced steam out of the water tank.

As the boiling water in the water tank 3 evaporates and the atmospheric steam is delivered to the steam distributor 6, concentration of the TDS (total dissolved solids) in the boiling water rises and the water level in the water tank slowly drops from the high water level point 41*a* to the low point 41*b*. The concentration of TDS in the boiling water increases in proportion to the volume of the water evaporated between the two water level points. When the water level drops to the low point 41*b*, the water level float switch 52 activates the feed water solenoid valve 18 to permit a controlled flow of feed water through the flow restrictor 40 into the water tank 3. Opening of the feed water solenoid valve starts the second operating period of the steam generation process cycle.

The second operating period involves the process steps of a continuous flow of incoming feed water, a continuous combustion of fuel and transfer of heat from combustion gases to boiling water, separation of the produced steam from the boiling water, dilution of the TDS in the boiling water, and discharge of the produced steam out of the water tank.

During the second operating period the heat transferred to the boiling water is used to heat the feed water to its boiling temperature and to produce the required steam. As the amount of available process heat is limited, the capacity to produce steam is reduced by the amount of heat used up in heating of the feed water to its boiling temperature. To permit the required minimum steam generation rate, the flow rate of feed water is limited by restrictor 40. Due to the incoming feed water, concentration of TDS in the boiling water drops. When the boiling water reaches the high water level point 41*a*, the high water level switch 51 activates a variable timer 47. This initiates the third operating period of the steam process cycle.

The third is similar to the second, with the continuous flow of incoming feed water causing the level of the water in the tank to continue to rise until the level reaches an overflow skimmer pipe 19. The top edge of this skimmer 19 is located slightly above the high water level point 41*a*.

Water flows out the overflow skimmer to drain for a predetermined time period, dependent on the known TDS concentration of the feed water, to reduce the TDS concentration of the water in the water tank. The end of the timed period deactivates the feed water solenoid valve 18 to complete the third operating period of the steam process cycle and start a new cycle.

By the described correctly adjusted timed overflow period, concentration of the hard scale forming substances in the boiling water is maintained within their solubility limits with minimum overflow (blowdown) of the concentrated boiling water.

An alternate method of controlling the amount of overflow water is shown in FIG. 3. In this method the upper edge of the overflow skimmer 19 is located slightly below the high water level 41*a*. During operating period 2, water flows into the skimmer 19 and fills a fixed volume blowdown chamber 27. At the end of operating period 2, the high water float control deactivates the feed water solenoid and activates a solenoid drain valve 46 to allow the water in the blowdown chamber 27 to flow through a strainer 28, and through the solenoid drain valve to drain 43, to end the cycle. The tank providing blow down chamber 27 is vented to atmosphere by vent pipe 27*a*.

By maintaining the concentration of TDS in the boiling water within the solubility limits of the hard scale forming substances, the build up of the hard scale on the water tank walls is minimized and the clean up maintenance of the water tank during the operating season is minimized or avoided.

While the preferred embodiment has been described with feed water containing TDS, it can be appreciated that the apparatus of the present invention can also operate effectively with deionized or reverse osmosis water. In the latter instance the variable timer 47 is switched off or the blowdown chamber 27 is eliminated.

The boiling blowdown water may flow through a heat exchanger to preheat the incoming feed water to improve efficiency and also decrease the temperature of the drain water.

The incoming feed water may be made to pass through a feedwater preheater, not shown, which may be of the storage type. The required heat for the feedwater preheater would be recovered and transferred from the hot combustion gases 30. This would improve efficiency and reduce the reduction in steam output caused by introducing cold feedwater.

Combustion air 32 may be ducted from outside the building envelope by connecting a duct (not shown) to the forced draft fan 16.

Some features of the water tank design to lengthen time between tank cleaning requirement include the following:

extended surface areas of combustion chamber walls for low heat flux to reduce scale build up as would occur with a tubular combustion chamber configuration because of high temperatures and high heat concentration.

vertical combustion chamber and heat exchanger walls to encourage scale to drop off during on-off cycling due to expansion and contraction of the combustion chamber walls.

an area at the bottom of the tank to collect scale that drops off the walls of the water tank and combustion chamber that is not part of the heat exchange area and thus scale build up does not affect efficiency.

relatively small surface boiling area so vigorous boiling agitates TDS to maximize solids removed by skimmer.

For ease of cleaning the water tank and combustion chamber have large smooth surfaces with no hidden areas as would be unavoidable with a tubular heat exchanger design.

In the foregoing there is described a single unit which can be designed in size to fit the requirements and situation at hand. On the other hand the unit could be designed to provide a preselected rate of steam production and the capacity could be increased by connecting two or more such units in parallel. The heat exchanger, combustion chamber and water container is effectively a modular unit and two or more such units can readily be connected in parallel and if desired enclosed in a common outer casing H1.

As a further modification the output could be increased by an appropriate sized water tank perhaps 6 inches wider to accommodate a second combustion chamber/heat exchanger in the same water tank. A second system of gas controls and blower could operate independent of the first one so that one or the other or both burners could be operational at the same time. The operational advantage is that one of the burner systems could be shut off to achieve a lower output when required.

In a still further modification two or more burners can be located in a single combustion chamber/heat exchanger unit. Suitable operational controls may be provided for operating one or the other burners for lower outputs or both at the same time for maximum output.

Figure 6:
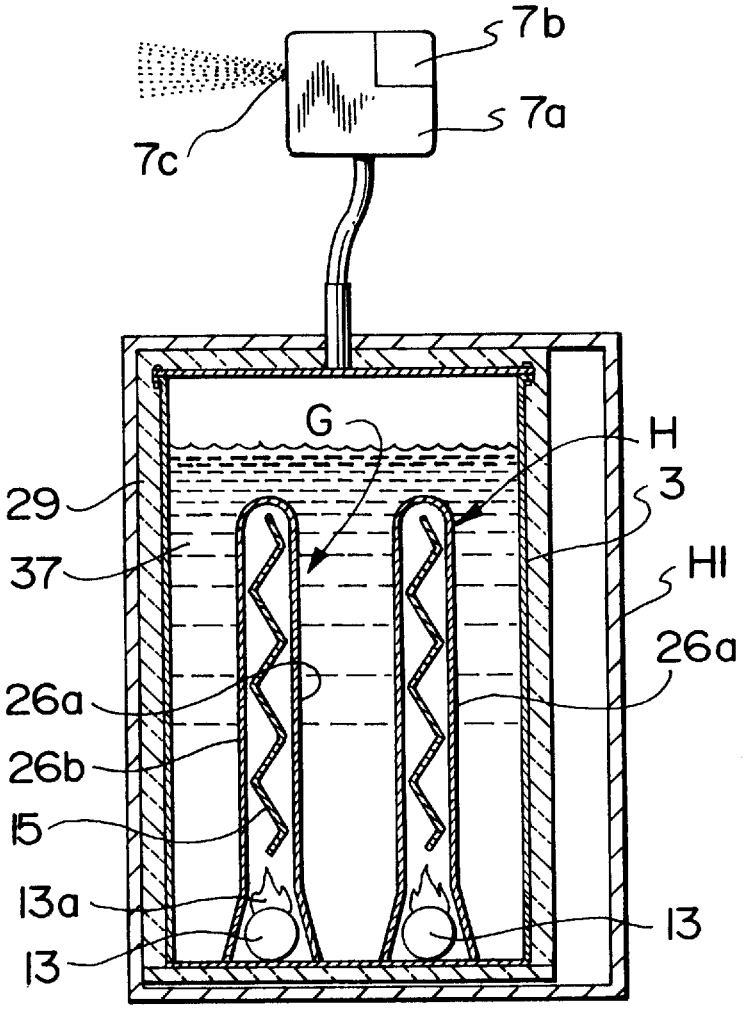
FIG. 6 is a view similar to FIG. 5 but illustrating two combustion chamber heat exchanger units in a single water tank.

The further modification referred to above is illustrated in FIG. 6 in which there are respective units G and H in a single water tank 3. While the unit illustrated is a stand alone humidifier it is obvious this modification is also applicable to the heating system type illustrated in FIG. 1. In FIG. 6 each combustion chamber/heat exchanger chamber and burner is a modular unit and the same as that described previously with reference to FIG. 5 or FIGS. 2 and 3.

I claim:

1. A gas fired steam generating humidifier comprising:

(a) a water tank having side walls, end walls, a bottom wall and a top wall defining a closed chamber for holding a selected quantity of water in which the free upper surface of such quantity of water is spaced downwardly from said top wall;

(b) walls defining a water free cavity within said water tank, said cavity providing a lower combustion chamber portion and an upper heat exchanger chamber portion, a major area portion of said walls providing said combustion chamber and heat exchanger portions being disposed generally vertically and spaced from said water tank side walls;

(c) an air-fuel burner in said combustion chamber portion;

(d) an exhaust outlet conduit means communicating with said heat exchanger chamber portion and extending through a wall of the water tank for discharging combustion gases from said burner into the atmosphere;

(e) a steam discharge passage means, separate and distinct from said exhaust outlet means, having an inlet thereto in said water tank at a position above said water free upper surface and an outlet disposed exteriorly of said water tank; and (f) means for controlling generation of steam by said humidifier in response to humidification requirements.

2. A humidifier as defined in 1 wherein said water free cavity providing said heat exchanger chamber portion is defined by a pair of elongate, spaced apart, generally vertically disposed, walls which are interconnected at their upper end.

3. A humidifier as defined in claim 2 including baffle means in said heat exchanger chamber.

4. A humidifier as defined in claim 3 wherein said baffle means provides a plurality of horizontal parallel paths in series for flow of the products of combustion from said burner, during operation of the same, to said exhaust conduit means.

5. A humidifier as defined in claim 3 wherein said baffle means provides a first primary zig-zag path for the products of combustion and a secondary leakage flow path that is generally perpendicular to said first path.

6. A humidifier as defined in claim 2 wherein said water tank bottom wall has an upwardly extending portion providing said pair of vertically disposed walls and said interconnection of the same.

7. A humidifier as defined in claim 1 including heat insulation surrounding said water tank and combined combustion and heat transfer chamber.

8. Apparatus for use in producing steam which is used to humidify air in a building comprising:

(a) a water tank having walls providing a container for holding a preselected quantity of water;

(b) a fuel-air combustion system for heating water in said tank to produce steam, said combustion system including a combustion chamber within said water tank, a fuel-air burner located in said combustion chamber, a heat exchanger having a chamber contiguous with said combustion chamber and providing passageway means of selected length for the flow therethrough of the products of combustion produced during operation of said burner, said heat exchanger chamber and combustion chamber being defined by walls having at least a major area portion thereof disposed generally vertically and in direct contact with water of said selected quantity in said water tank, combustion control means including humidistat means controlling steam production responsive to humidification requirements, exhaust outlet means from said heat exchanger chamber for discharging the products of combustion during operation of said burner, and means to cause said products of combustion to flow through said heat exchanger chamber and discharge from said exhaust outlet means;

(c) outlet means from said water tank, separate and distinct from said exhaust outlet means, for discharge of steam produced by boiling water in said tank; and (d) means connectable to a water supply for supplying make up water to said water tank.

9. Apparatus as defined in claim 8 including baffle means located in said heat exchanger chamber to direct the flow of combustion gases therethrough.

10. Apparatus as defined in claim 9 wherein said baffle means define a first primary path for said combustion gases and a second secondary leakage path.

11. Apparatus as defined in claim 10 wherein said first path is a zig-zag path through said heat exchanger chamber.

12. Apparatus as defined in claim 10 wherein said baffle means and heat exchanger defining walls have spaces therebetween providing said second secondary leakage flow path for said combustion gases.

13. Apparatus as defined in claim 12 wherein said first path is a zig-zag path and wherein said second path is generally transverse thereto.

14. Apparatus as defined in claim 13 wherein said first zig-zag path is primarily horizontal and disposed in a vertical plane.

15. Apparatus as defined in claim 8 including a steam distributor and means directing steam thereto from said water tank steam outlet means.

16. Apparatus as defined in claim 15 wherein said steam distributor is mounted on said water tank.

17. Apparatus as defined in claim 16 including an air fan compartment means, said steam distributor means being located in said compartment means.

18. Apparatus as defined in claim 17 wherein said humidistat means is a modulating type humidistat for controlling the production of steam, wherein the fuel is gas and wherein valve means is provided for a gas supply line to said burner, said valve means being a proportional solenoid gas valve.

19. Apparatus as defined in claim 8 including a steam distributor means for distributing steam, produced in said water tank, into a stream of air; means connecting said steam distributor to said water tank steam outlet means; and draft producing means for said combustion system; said combustion control means being operatively inter-related with said humidistat means, and said combustion system draft producing means.

20. Apparatus for use in producing steam which is used to humidify air in a building comprising:

(a) a water tank having walls providing a container for holding a preselected quantity of water;

(b) a fuel-air combustion system for heating water in said tank to produce steam, said combustion system including a combustion chamber, a fuel-air burner located in said combustion chamber, a heat exchanger having a chamber contiguous with said combustion chamber and providing passageway means of selected length for the flow therethrough of the products of combustion produced during operation of said burner, said heat exchanger chamber being defined by walls having at least a major area portion thereof in direct contact with water of said selected quantity in said water tank, combustion control means, exhaust outlet means from said heat exchanger chamber for discharging the products of combustion during operation of said burner, and means to cause said products of combustion to flow through said heat exchanger chamber and discharge from said exhaust outlet means;

(c) outlet means from said water tank for discharge of steam produced by boiling water in said tank; and (d) means connectable to a water supply for supplying make up water to said water tank, a steam distributor and means directing steam thereto from said water tank steam outlet means and wherein said steam distributor is disposed at a position remote from said apparatus and including means to return condensate from said distributor to said water tank.

21. Apparatus as defined in claim 20 including monitoring means for monitoring the operation and performance of said apparatus.

22. Apparatus for use in producing steam which is used to humidify air in a building comprising:

(a) a water tank having walls providing a container for holding a preselected quantity of water;

(b) a fuel-air combustion system for heating water in said tank to produce steam, said combustion system including a combustion chamber, a fuel-air burner located in said combustion chamber, a heat exchanger having a chamber contiguous with said combustion chamber and providing passageway means of selected length for the flow therethrough of the products of combustion produced during operation of said burner, said heat exchanger chamber being defined by walls having at least a major area portion thereof in direct contact with water of said selected quantity in said water tank, combustion control means, exhaust outlet means from said heat exchanger chamber for discharging the products of combustion during operation of said burner, and means to cause said products of combustion to flow through said heat exchanger chamber and discharge from said exhaust outlet means;

(c) outlet means from said water tank for discharge of steam produced by boiling water in said tank; and (d) means connectable to a water supply for supplying make up water to said water tank;

(e) a steam distributor means for distributing steam, produced in said water tank, into a stream of air; means connecting said steam distributor to said water tank steam outlet means; humidistat means for controlling the production of steam; and draft producing means for said combustion system; said combustion control means being operatively inter-related with said humidistat means and said combustion system draft producing means and wherein said humidistat means is a modulating type humidistat for controlling the production of steam, said combustion control means being interconnected with said humidistat means, with a fuel supply valve means in which such valve means includes conventional constant ratio gas/combustion air valve train means, and wherein said combustion system draft means comprises a forced draft producing means.

23. A fuel-air fired humidifier comprising:

(a) means defining a closed water holding tank, said tank having a removable portion providing access to the interior thereof for periodically removing scale that accumulates in the bottom thereof during use of the humidifier;

(b) wall means defining a combustion chamber and a heat exchanger chamber, said chambers being water free and located within the confines of said water tank, a major area portion of said walls being disposed generally vertical;

(c) a fuel-air burner located in said combustion chamber;

(d) means responsive to signals from a humidistat to controllably supply a fuel air mixture to said burner for generating steam in response to humidification requirements;

(e) an exhaust outlet means from said heat exchanger chamber for discharge of the products of combustion produced during operation of said burner; and (f) a steam outlet means from said water tank, separate and distinct from said exhaust means, for discharge of steam produced from water in the tank heated by operation of said burner.

24. A humidifier as defined in claim 23 wherein said water tank and said chambers are defined by walls separate from one another.

25. A humidifier as defined in claim 23 including means to controllably supply water to said tank and means operating in conjunction therewith to maintain the water within a preselected upper and low water level within the water tank.

26. A humidifier as defined in claim 23 including a further fuel-air burner located in said combustion chamber.

27. A humidifier as defined in claim 23 wherein said combustion chamber/heat exchanger chamber and fuel air burner is a modular unit and wherein there are at least two such modular units located in said water holding tank.

28. A fuel-air fired humidifier comprising:

(a) means defining a closed water holding tank;

(b) means defining a combustion chamber and a heat exchanger chamber, said chambers being water free and located within the confines of said water tank;

(c) a fuel-air burner located in said combustion chamber;

(d) means to controllably supply a fuel air mixture to said burner;

(e) an exhaust outlet means from said heat exchanger chamber for discharge of the products of combustion produced during operation of said burner; and (f) a steam outlet means from said water tank for discharge of steam produced from water in the tank heated by operation of said burner said water tank being defined by walls including end walls and wherein said combustion chamber and heat exchanger chamber are contiguous defined by an outer U-shaped wall connected to opposed end walls.

29. A humidifier as defined in claim 28 wherein said end walls comprise said water tank respective end walls.

* * * * *